United States Patent [19]

Cooper

[11] 4,357,373

[45] Nov. 2, 1982

[54] APPARATUS FOR APPLYING LATEX COATING TO MOVING FABRIC

[75] Inventor: John H. Cooper, Lancaster, Pa.

[73] Assignee: Armstrong World Industries, Inc., Lancaster, Pa.

[21] Appl. No.: 254,219

[22] Filed: Apr. 15, 1981

[51] Int. Cl.[3] ..... B05D 3/12

[52] U.S. Cl. ..... 427/358; 118/118; 118/123; 118/413; 118/414; 156/72; 427/359; 427/389.9

[58] Field of Search ..... 118/407, 413, 414, 415, 118/118, 123; 427/358, 359, 373, 244, 389.9; 156/72

[56] References Cited

U.S. PATENT DOCUMENTS 3,783,823 1/1974 Sicuert et al. ..... 118/415 X
4,016,831 4/1977 James et al. ..... 118/415
4,109,034 8/1978 Welch ..... 427/358 X

FOREIGN PATENT DOCUMENTS 495697 3/1977 Australia ..... 427/358

*Primary Examiner*—Michael R. Lusignan

[57] ABSTRACT

A fabric to have a latex coating of controlled thickness applied to its upper surface moves toward a drying oven. The lower surface of the moving fabric contacts a supporting bedplate. A latex coating is applied to the upper surface of the moving carpet across the width of the carpet. The moving carpet with the latex coating travels underneath a nip roll. A flexible nip blade is positioned underneath the nip roll so that the edge of the nip blade extends beyond the bottom dead center of the nip roll in the direction of the drying oven. Both the nip roll and the nip blade extend across the width of the moving carpet.

10 Claims, 1 Drawing Figure

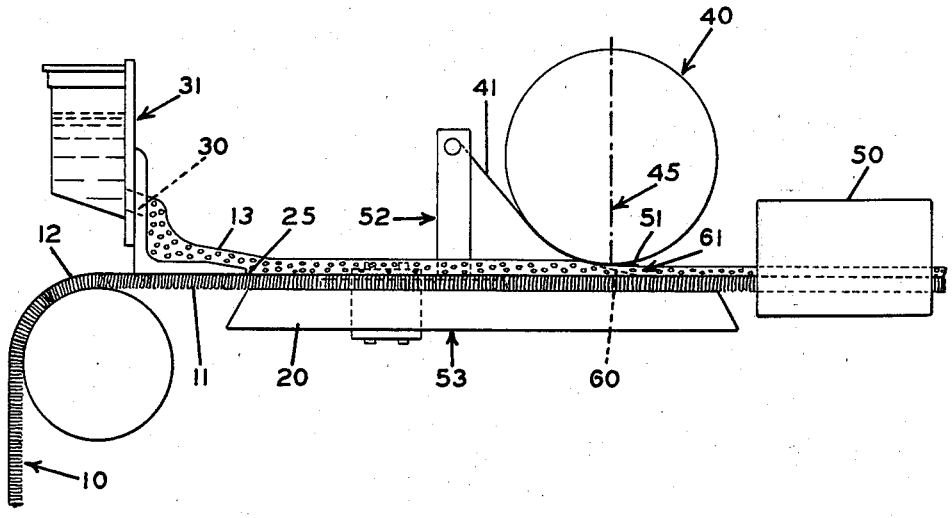
40
31
41
30
45
50
13
25
52
51
61
12
11
20
53
60
10

APPARATUS FOR APPLYING LATEX COATING TO MOVING FABRIC

BACKGROUND OF THE INVENTION

Many methods of applying liquid binding material to the back side of fabrics are known in the art. For example, U.S. Pat. No. 4,016,831 teaches applying foam backing to a fabric without the introduction of hose and streak marks on the fabric. A foam pillow is established on a fabric by confining it on two sides with guide plates, and on the front with a doctor blade or stationary rollers. The fabric is started moving, whereby the pillow is caused to generally roll or rotate about a generally horizontal axis. A gap of predetermined size between the bottom of the doctor blade or roller and the top surface of the fabric allows only a portion of the foam from the pillow to adhere to the fabric and be carried along therewith, the foam providing a backing for the fabric. The volume of foam in the pillow is maintained by the introduction of new foam into the volume of the pillow to at least two points on either side of the pillow, to flow generally along the axis of rotation of the pillow.

In another typical method of applying foam backing to a fabric, foam is applied to the upper surface of a moving fabric across the width of the fabric. The fabric, with the foam on its upper surface, then moves underneath an inflexible nip roll which extends across the entire width of the moving fabric and which is positioned a uniform distance above the upper surface of the moving fabric. The extent of this distance will determine the thickness of the foam backing on the moving carpet. After the moving fabric passes under the nip roll, it then travels to a drying oven.

The above-described method has proved to be satisfactory for applying foam backing to a carpet. It has been discovered, however, that problems occur when latex backing is substituted for foam backing in the above method. The use of the nip roll produces ripples in the fabric backing. Furthermore, after a period of time, the latex tends to dry and accumulate on the nip roll. This directly affects the amount of latex that can be applied to the fabric; moreover, the fabric backing tends to be uneven in thickness. It becomes necessary, in order to put a sufficient amount of latex down on the fabric, to pass the fabric by the latex applicator twice. Alternatively, the operator may choose to periodically close down the line to clean off the nip roll. Both alternatives are very time-consuming and, ultimately, very costly.

It would be desirable therefore, to be able to convert, with a minimum of effort, a standard foam application apparatus to utilize latex without any of the problems described above.

BRIEF DESCRIPTION OF THE FIGURE

The FIGURE is a cross-section diagrammatic of the invention's preferred apparatus for controlling the thickness of a latex coating backing applied to a moving fabric.

DETAILED DESCRIPTION OF THE INVENTION

This invention relates to applying a liquid binder to a moving sheet material.

Specifically, this invention relates to an apparatus and method for applying a smooth latex coating of uniform thickness to the back of a moving carpet structure.

This invention also relates to an improvement in a typical foam applicator apparatus, and method, which method generally comprises (1) applying foam to the upper surface of a moving fabric across the width of the fabric and (2) moving the fabric underneath a nonmoving thickness control means, such as a nip roll, which extends across the entire width of the moving fabric and which is positioned a uniform distance above the upper surface of the moving fabric. The fabric lies on a supporting structure such as a bedplate.

By utilizing the present invention, it is now possible to conveniently convert a prior art foam applicator apparatus and method to use latex coating material with none of the disadvantages set forth above.

A standard foam applicator apparatus such as described above, which is utilized to apply foam backing material to the upper surface of a moving sheet material is converted to utilize latex by positioning a flexible nip blade underneath the apparatus' nonmoving nip roll. The nip blade is positioned so that the edge of the blade in contact with the latex extends beyond the bottom dead center of the nip roll in the direction of the drying oven.

The nip blade is made from a durable material that is flexible enough to be bent when it comes in contact with the latex coating. The part of the nip blade that comes in contact with the coating should be made, or at least covered, by a material that will not be corroded by the coating or abraided by the constant movement of the coating against the blade edge. The preferred nip blade material is tempered spring steel. The nip blade can be attached to the frame of the apparatus by any convenient method, just as long as the attaching method utilized does not interfere with the application of the latex to the fabric. Preferably, each end of the nip blade is secured to the fabric's supporting frame well beyond each end width of the fabric. Thus, the nip blade itself will preferably be wider than the fabric being coated.

The nip blade is positioned so that the pressure of the moving latex coating will displace one edge of the blade sufficiently so that this edge will be on top of the latex coating and will therefore lie in a plane that is substantially parallel to the plane of the coating. The other edge of the nip blade is on the side of the nip roll farthest from the drying oven. The blade extends underneath the nip roll and a portion of the blade is always in contact with the underside of the nip roll, irregardless of whether the blade is straight or is bent by the latex coating. One edge of the nip blade will extend beyond the bottom dead center of the nip roll, in the direction of the drying oven or, differently put, in the direction in which the carpet is moving. Care should be taken not to have the nip blade extend out too far from beyond the nip roll's bottom dead center since this may cause the blade to be unduly supple and may result in a nonuniform application of latex and ripples in the latex coating. As a general rule, no more than about $\frac{1}{8}$ of the blade width should extend beyond the bottom dead center point of the nip roll, although this FIGURE will depend to a great deal on the composition, and ultimately the flexibility, of the blade.

It has been discovered that the combination of the latex coating's upward pressure against the nip blade and the blade's tendency to push downward to assume its natural straight position serves to keep the blade free from latex accumulation.

With reference to the FIGURE, a carpet 10, which in this example ranges from 146 to 148 inches wide, having a face side 11 and a back side 12 is to have coating material 13 applied to the back side 12 of carpet 10. The carpet 10 travels on top of support means 20, in this example a bedplate. The latex coating material 13 utilized in this example is a carboxylated SBR latex that is conventionally utilized on the back side 12 of various forms of carpet 10. The coating material 13 passes from opening 30 in transverse latex applicator 31 to the carpet 10. The transverse latex applicator 31 applies the coating material 13 across the entire width of carpet 10 at point of application 25. As carpet 10 moves to drying oven 50, it travels under both a coating thickness control device 40, which in this example is a 8" diameter, 17'5" long nip roll for foam which is positioned $\frac{1}{4}$" to $\frac{1}{2}$" above the back side 12 of carpet 10, and a nip blade 41 which, in this example, is 15 feet long, is 8" wide, 0.015" thick and has edges 51 and 54. Nip blade 41 is positioned under coating thickness control device 40 so that the edge 51 of nip blade 41 extends $\frac{5}{8}$" beyond the bottom dead center point 45 of coating thickness control device 40 in the direction of drying oven 50. Edge 54 of nip blade 41 is positioned on the side of thickness control device 40 farthest from drying oven 50. Nip blade 41 is positioned so that it is always in contact with thickness control device 40, such as at contact area 62. Both the coating thickness control device 40 and the nip blade 41 extend at least across the entire width of carpet 10. Each end of the nip blade 41 is secured to support means 20 such as by being attached to support frame 52 which in turn is secured to support means 20 by the use of clamp 53.

Dotted line 60 indicates the unbent path of nip blade 41, that is, the path nip blade 41 takes when it does not come in contact with coating material 13, which contact results in displacement 61 of nip blade 41.

The carpet 10 may be moved along by conventional means such as rollers and/or by engagement with conveyor belts or the like. The nip blade 41 controls the amount of latex coating material 13 that is applied to the back side 12 of carpet 10 to produce a more uniform latex coating on the back side 12 of carpet 10. This more uniform coating will overcome many of the problems of uneven of ununiform latex coating on the back side of carpet caused when such latex coating is applied using a coating applicator that is normally utilized for applying foam backing.

What is claimed is:

1. In an apparatus for applying a liquid binder to a moving sheet material that travels from a liquid binder applicator station to a drying oven to provide a backing for said sheet material comprising:

(a) support means for the lower side of the moving sheet material;

(b) a fluid applicator means for applying a substantially uniform amount of the liquid binder across the width of the moving sheet material on the upper surface of said sheet material; and (c) an inflexible coating thickness control means which extends across the width of the moving sheet material and which is positioned at a uniform distance above the upper surface of said moving sheet material;

the improvement comprising positioning a flexible nip blade underneath the coating thickness control means across the width of the moving sheet material so that an edge of the nip blade extends beyond the bottom dead center point of the thickness control means in the direction of the drying oven.

2. The apparatus of claim 1 wherein the coating thickness control means is a nip roll.

3. The apparatus of claim 1 wherein the moving sheet material comprises carpet.

4. The apparatus of claim 1 wherein no more than one-eighth of the width of the nip blade extends beyond the bottom dead center point of the thickness control means in the direction of the drying oven.

5. The apparatus of claim 4 wherein the nip blade is made of spring steel.

6. In a method for applying a substantially even coat of a liquid binder to a moving sheet material that travels from a liquid binder applicator station to a drying oven to provide a backing for said sheet material comprising:

(a) applying a substantially uniform amount of the liquid binder across the width of the moving sheet material on the upper surface of said material; and (b) passing said sheet material underneath an inflexible coating thickness control means which extends across the width of the moving sheet material and which is positioned at a uniform distance above the upper surface of said moving sheet material;

the improvement comprising positioning a flexible nip blade underneath the coating thickness control means across the width of the moving sheet material so that an edge of the nip blade extends beyond the bottom dead center point of the thickness control means in the direction of the drying oven.

7. The method of claim 6 wherein the coating thickness control means is a nip roll.

8. The method of claim 6 wherein the moving sheet material comprises carpet.

9. The method of claim 6 wherein no more than one eighth of the width of the nip blade extends beyond the bottom dead center point of the thickness control means in the direction of the drying oven.

10. The method of claim 9 wherein the nip blade is made of spring steel.

* * * * *